US008349100B2

(12) United States Patent
Sunaga

(10) Patent No.: US 8,349,100 B2
(45) Date of Patent: Jan. 8, 2013

(54) METHOD FOR PRESS-MOLDING EMBOSSED STEEL PLATE

(75) Inventor: Susumu Sunaga, Ashikaga (JP)

(73) Assignee: Fukai Seisakusho Co., Ltd., Ashikaga (JP)

( * ) Notice: Subject to any disclaimer, the term of this patent is extended or adjusted under 35 U.S.C. 154(b) by 48 days.

(21) Appl. No.: 13/144,990

(22) PCT Filed: Jan. 20, 2010

(86) PCT No.: PCT/JP2010/050585

§ 371 (c)(1),
(2), (4) Date: Jul. 18, 2011

(87) PCT Pub. No.: WO2010/084864

PCT Pub. Date: Jul. 29, 2010

(65) Prior Publication Data

US 2011/0272068 A1 Nov. 10, 2011

(30) Foreign Application Priority Data

Jan. 23, 2009 (JP) ..... 2009-012593

(51) Int. Cl.
*C21D 8/00* (2006.01)

(52) U.S. Cl. ..... 148/654; 148/653; 148/647; 148/648; 148/649

(58) Field of Classification Search ..... 148/645–649, 148/653, 654
See application file for complete search history.

(56) References Cited

U.S. PATENT DOCUMENTS 7,117,708 B2 * 10/2006 Yamano et al. ..... 72/350
2003/0066582 A1 * 4/2003 Gehringhoff et al. ..... 148/648

FOREIGN PATENT DOCUMENTS

| | | |
|---|---|---|
| JP | A-56-069151 | 6/1981 |
| JP | A-2005-007442 | 1/2005 |
| JP | A-2005-205453 | 8/2005 |
| JP | A-2006-529002 | 12/2006 |
| JP | A-2007-075835 | 3/2007 |
| JP | A-2008-180125 | 8/2008 |

OTHER PUBLICATIONS

International Search Report issued in International Application No. PCT/JP2010/050585 on Apr. 6, 2010 (with translation).
Office Action issued in Japanese Patent Application No. 2010-547490 dated Apr. 27, 2011 (with translation).

* cited by examiner

*Primary Examiner* — Deborah Yee
(74) *Attorney, Agent, or Firm* — Oliff & Berridge, PLC

(57) ABSTRACT

A method for press-molding an embossed steel plate is able to cool even an embossed steel plate under conditions adequate for quenching.
After a plate body with convex portions formed thereon is placed between an upper pressing die and a lower pressing die and the dies are closed, first and second circulation pumps are run to circulate cooling water.

2 Claims, 4 Drawing Sheets

METHOD FOR PRESS-MOLDING EMBOSSED STEEL PLATE

TECHNICAL FIELD

The present invention relates to a method for press-molding an embossed steel plate. In particular, the present invention relates to a method for press-molding a steel plate embossed in a pattern in which a series of convex portions, a series of concave portions, or a series of concave and convex portions is repeated, as in the structural members, reinforcement members, etc., of a vehicle in order to obtain required rigidity.

BACKGROUND ART

Conventionally, for example, in order to achieve both safety in the event of collision, and a vehicle weight reduction for fuel cost improvement, high-tensile steel is used for structural members and reinforcement members for a vehicle. However, when the high-tensile steel plate is press-molded with dies during manufacture, a processed product may, for example, spring back (i.e., return to its original shape after deformed), and suffer from insufficient shape retention after press-molding, making it difficult to manufacture a good quality product. To overcome the foregoing, the shapes of dies are modified in advance taking account of the degree to which a processed product may spring back, and the like, or the number of steps for modifying the shape is increased, which is not economical.

Therefore, in order to increase the strength of a pressed component, the following has been developed: a method (see, e.g., Patent Document 1) in which a heated steel plate is press-molded by dies while a hot condition is maintained (e.g., hot pressing) and is quenched while in the dies to achieve a high-tensile steel; and a technology for high-frequency quenching. However, high-frequency quenching requires considerable know-how in the quenching and cooling method, and has not been generally used. Hot pressing, in which the foregoing problems occur relatively rarely, is widespread and has become a general technology.

However, the conventional hot pressing includes: heating a material to a temperature (about 950° C.) lower than its melting point by equipment such as a heating furnace before press processing; and molding the material between the upper and lower dies by press processing and, at the same time, carrying out quenching through sudden cooling. Thereby, a product with the considerable strength of about 1500 MPa is obtained. However, although the product thus obtained is rendered very strong, it is a form of iron and, therefore, is not different in Young's modulus from low-tensile-strength iron, which is generally called steel. Once the material is determined, its static rigidity is determined according to the plate thickness. Accordingly, rendering the material very strong does not always allow the material to be thinned readily. Therefore, conventionally, the use of hot pressing is limited to products that are originally sufficiently rigid or to components that can be made more rigid through a design technique such as increasing cross-sectional area or modifying cross-sectional shape.

PRIOR ART DOCUMENT

Patent Document

Patent Document 1: Japanese Patent Application Laid-Open No. 2005-205453

DISCLOSURE OF THE INVENTION

Problems to be Solved by the Invention

Therefore, embossing technology in which even when the material and plate thickness are the same, greater load has to be applied in certain places, may be used taking into account the effect of improving bend resistance. However, the quenching structure of conventional dies is such that, a cooling medium passage where a cooling medium is supplied is formed in the die near the cavity of the die, and the cooled cavity defining face of the die and a plate are brought into contact with each other to exchange heat. Therefore, if an embossed steel plate is used, the area of contact is small, and heat exchange cannot be guaranteed, thus failing to satisfy conditions for quenching.

The present invention has been proposed to overcome the foregoing problems, and it is, therefore, an object of the invention to cool even an embossed steel plate under conditions adequate for quenching.

Means for Solving the Problems

According to a first invention, there is provided a method for press-molding a steel plate embossed in a pattern which a series of convex portion, a series of concave portions, or a series of concave and convex portions is repeated in order to obtain required rigidity, the method including: accommodating the steel plate in a cavity defined by an upper die and a lower die and closing the dies, thereby applying pressure to the steel plate such that an empty space is defined between the steel late and the cavity defining face of the upper or lower die by virtue of the convex portions, concave portions, or concave and convex portions; and quenching the steel plate by supplying a cooling medium into a plurality of cooling medium passages formed in at least one of the upper and lower dies along the cavity and into communication channels formed such that the cavity and the cooling medium passages communicate, and by circulating the cooling medium within each of the cooling medium passages, each of the communication channels, and the empty space defined in the cavity between the steel plate and the cavity defining face of the upper or lower die. And according to a second invention, there is provided a method for press-molding a steel plate embossed in a pattern in which a series of convex portions, a series of concave portions, or a series of concave and convex portions is repeated in order to obtain required rigidity, the method including: austenite-transforming the steel plate; accommodating the austenite-transformed steel plate in a cavity defined by an upper die and a lower die and closing the dies thereby applying pressure to the steel plate such that an empty space is defined between the steel plate and the cavity defining face of the upper or lower die by virtue of the convex portions, concave portions, or concave and convex portions; and quenching the steel plate by supplying a cooling medium into a plurality of cooling medium passages formed in at least one of the upper and lower dies along the cavity and into communication channels formed such that the cavity and the cooling medium passages communicate, and by circulating the cooling medium within each of the cooling medium passages, each of the communication channels, and the empty space defined in the cavity between the steel late and the cavity defining face of the upper or lower die.

Effect of the Invention

The present invention provides a method for press-molding an embossed steel plate, the method being able to cool even an embossed steel plate under conditions adequate for quenching.

EXPLANATIONS OF REFERENCE NUMERALS

1 CENTER PILLAR REINFORCEMENT MEMBER
2 CONVEX PORTION
3 UPPER PRESSING DIE
4 LOWER PRESSING DIE
5,6 COOLING MEDIUM PASSAGE
7,8 COMMUNICATION CHANNEL
10 PLATE BODY

BEST MODES FOR CARRYING OUT THE INVENTION

Figure 1:
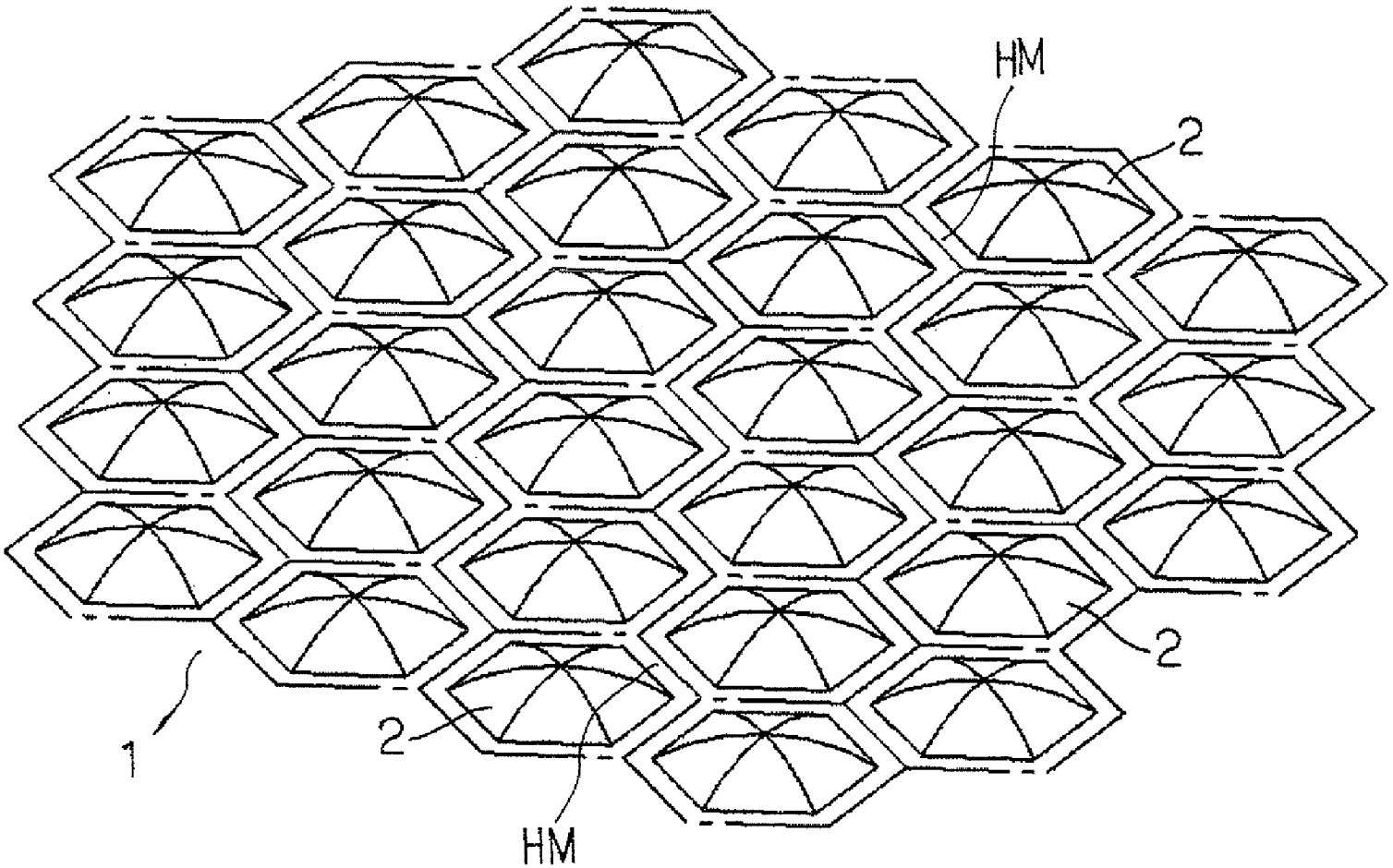
FIG. 1 is a partial perspective view of a center pillar reinforcement member.
Figure 2:
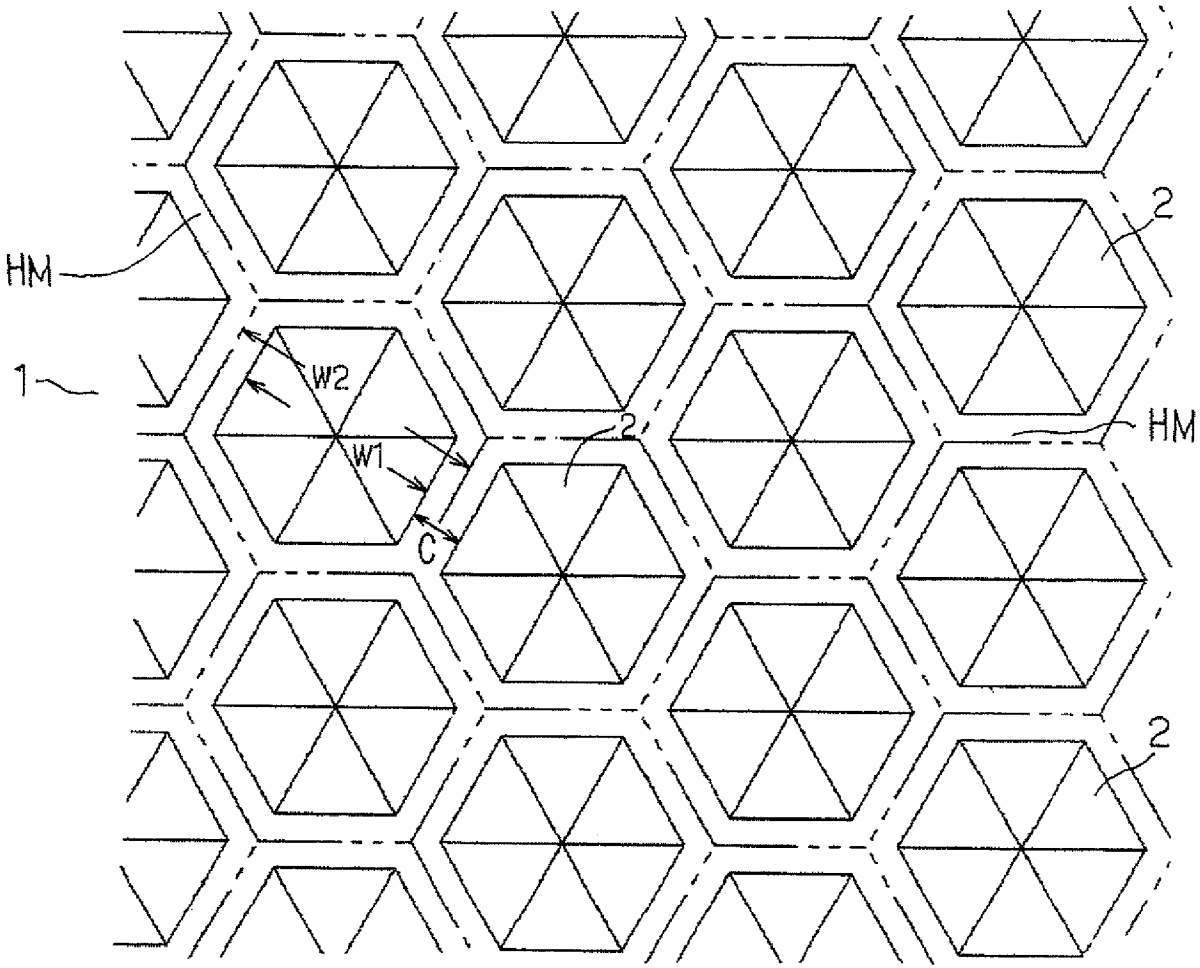
FIG. 2 is a partial plan view of a center pillar reinforcement member.

An embossed steel plate is used for a bumper reinforcement member, a door impact reinforcement member, a center pillar reinforcement member, etc., which are reinforcement members for a vehicle. An embodiment of a center pillar reinforcement member according to the present invention will now be described with reference to FIGS. 1 to 4. FIG. 1 is a partial perspective view of a center pillar reinforcement member 1, which is a reinforcement member for a vehicle, obtained by forming convex portions 2, i.e., embossed portions, on a steel plate and molding this steel plate. FIG. 2 is a partial plan view of a center pillar reinforcement member 1. The center pillar reinforcement member 1 is formed from a rectangular steel plate body of thickness of, for example, 0.8 mm or greater and 2.2 mm or less.

Next will be described a method for manufacturing the center pillar reinforcement member 1, that is, a method for compression-molding the center pillar reinforcement member 1. First, a large number of convex portions 2 are formed on the steel plate body 10 by emboss-molding in a manner that the convex portions 2 are arranged so that a flat plate portion HM between the convex portions 2 does not remain in a linear shape. The convex portions 2 are formed at the same interval. However, each one of the convex portions 2 is formed, for example, in a regular hexagonal shape in a plan view, and has a longitudinal section thereof, which includes vertices forming opposing corners of the hexagonal shape, in a circular arc shape. Each of the convex portions 2 may be formed in a circular shape in plan view, and have a longitudinal section thereof in a circular arc shape. Instead of the convex portions 2, concave portions may be formed on the plate body 10. Alternatively, both convex portions and concave portions may be formed.

The convex portions 2 of the plate body 10 are formed in a manner as described below. Specifically, the width W1 of each convex portion 2 of the plate body 10 is 10 mm or greater and 50 mm or less; the proportion of the width W1 of each convex portion 2 to the height H thereof is 12% or more and 20% or less; the convex portions 2 are arranged so that a flat plate portion HM between the convex portions 2 does not remain in a linear shape; and the interval C between adjacent convex portions 2 is, for example, 75% or less of the base width W2, that is, the sum of a half of the interval C and the width W1 of a convex portion 2. Accordingly, a pattern in which a series of convex portions 2 is repeated is formed as shown in FIGS. 1 and 2. The same applies whether a concave portion instead of the convex portions 2, or a combination of a concave and a convex portion, is used.

In the present embodiment, convex portions 2 as described above are formed on the plate body 10. However, the invention is not limited to this, and other shapes (i.e., shapes in plan view or cross-sectional shape) or other arrangements of convex portions 2 may be used. For example, convex or concave portions formed on the plate body 10 may have various forms.

Subsequently, before pressing, the plate body 10 with convex portions 2 as described above is austenite-transformed at a temperature below fusing point (in the range from 850° C. or more and 1100° C. or less) by equipment such as a heating furnace heated to, for example, 850° C. or more. This plate body 10 is accommodated and molded between upper pressing die 3 and lower pressing die 4 being provided with a cavity S that is an empty space of predetermined shape corresponding to the final shape of the center pillar reinforcement member 1. At this time, since the upper and lower die faces define cavities 5, most of the plate body 10 as a result of closing the dies and being pressed is molded into a required shape, for example, a U-shaped cross-section, without destroying the convex portions 2.

Figure 3:
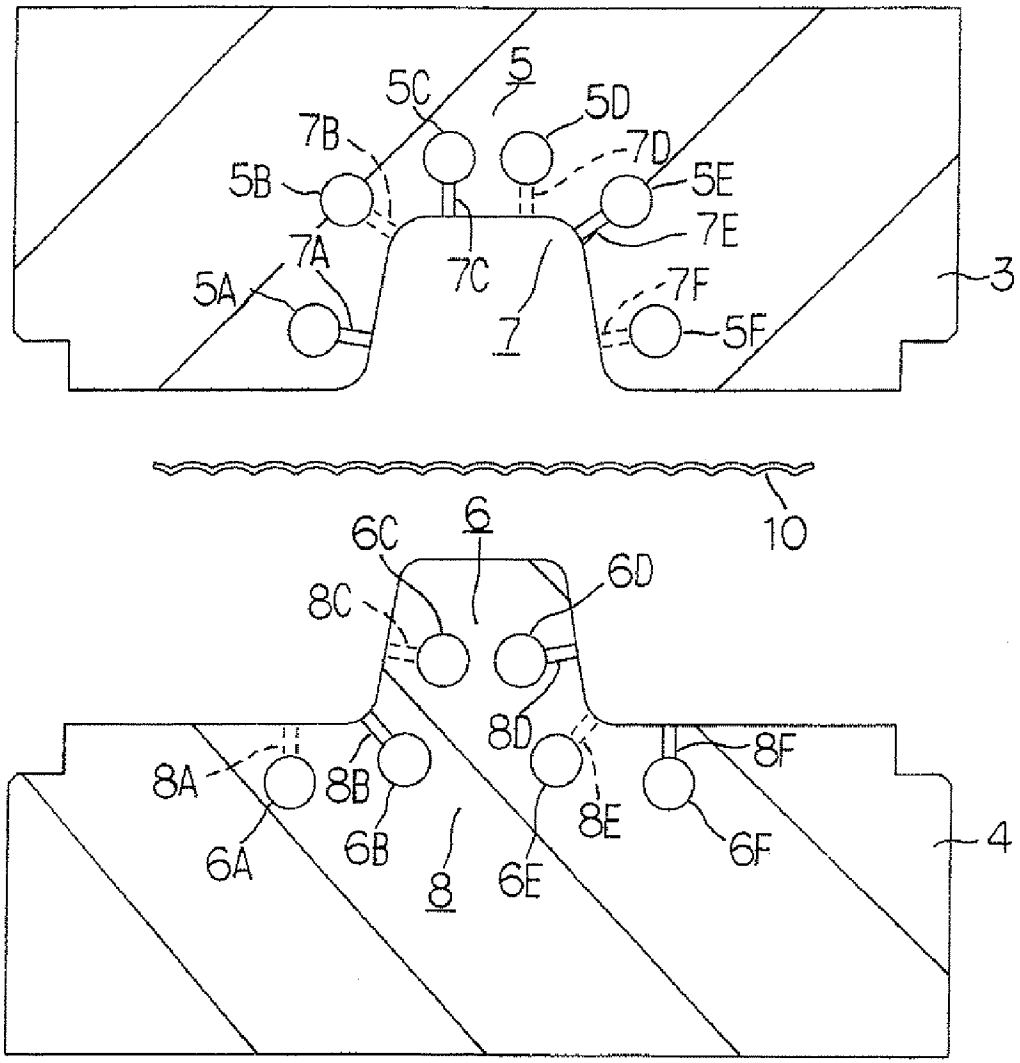
FIG. 3 is a longitudinal sectional view showing upper and lower pressing dies in an opened state.
Figure 4:
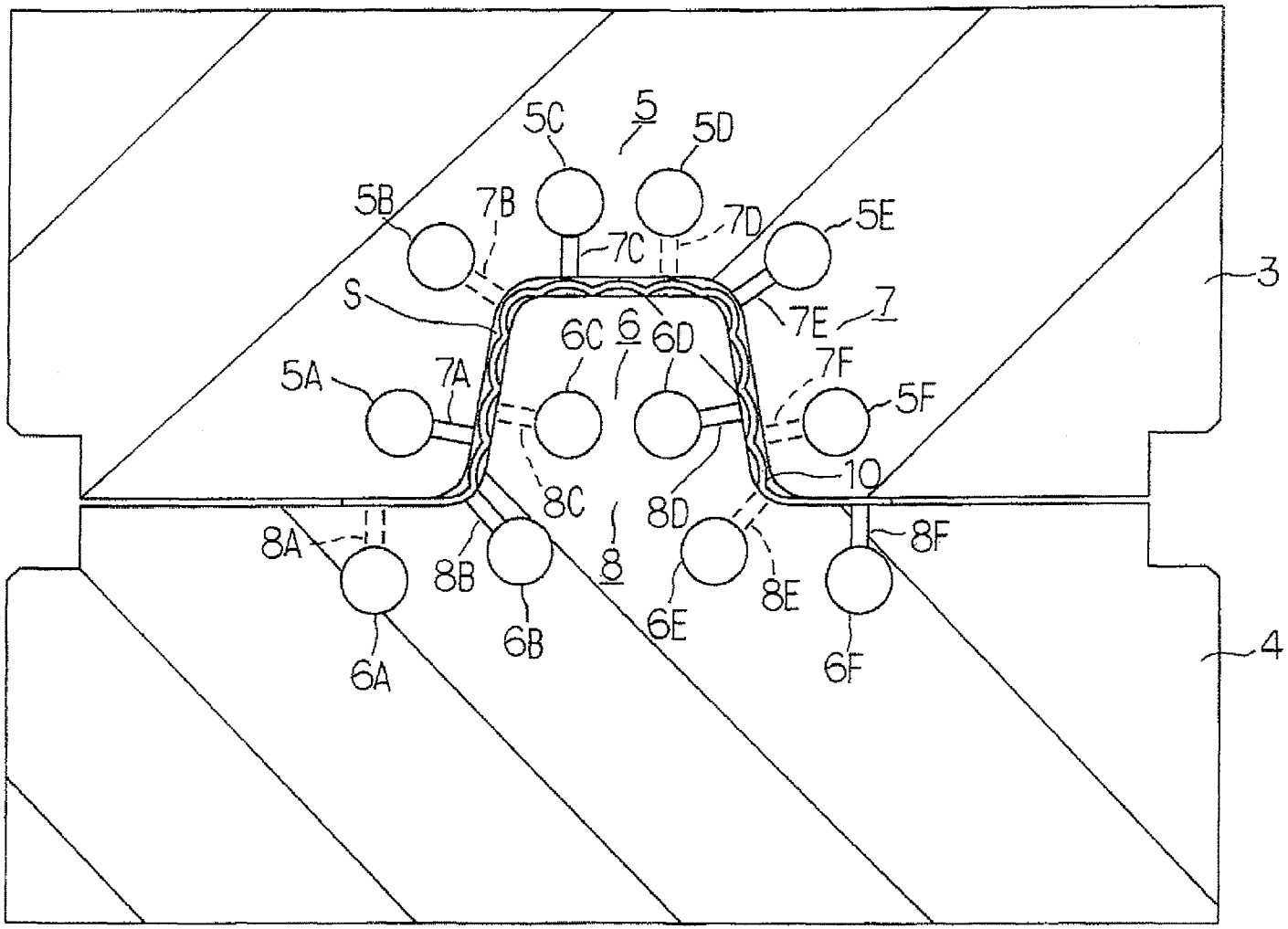
FIG. 4 is a longitudinal sectional view of the upper and lower pressing dies in a closed state.

As shown in FIGS. 3 and 4, a plurality of cooling medium passages 5 and 6 through which cooling water, or a cooling medium, is passed by a circulation pump (not shown) are defined along and near the cavity S in the upper pressing die 3 and lower pressing die 4. In addition, the cooling medium passages 5 and 6 are formed so as to communicate with the cavity S via communication channels 7 and 8 respectively. Further, cooling medium passages 5B, 5D, and 5F are made to communicate with cooling medium passages 5C, 5E, and 5A respectively. Similarly, cooling medium passages 6B, 6D, and 6F are made to communicate with cooling medium passages 6C, 6E, and 6A respectively.

Subsequently, the plate body 10 with the convex portions 2 is placed between the upper pressing die 3 and lower pressing die 4 as shown in FIG. 3, the dies 3 and 4 are closed and the plate body 10 is pressed as shown in FIG. 4. Consequently, the plate body 10 is bent into the final shape.

Then, in order that the center pillar reinforcement member 1 as final product be made a super strong steel of 1500 MPa-class strength, the upper pressing die 3 and the lower pressing die 4 are closed with the plate body 10 at a temperature of 630° C. or more therebetween, and the plate body 10 is cooled as quenching begins. Specifically, after the dies are closed, a first circulation pump is run to circulate supplied cooling water, as shown in FIG. 4, through the leftmost cooling medium passage 5A within the upper pressing die 3→the communication channel 7A→the cavity S→the communication channel 7B→the cooling medium passage 5B→the cooling medium passage 5C→the communication channel 7C→the cavity S→the communication channel 7D→the cooling medium passage 5D→the cooling medium passage 5E→the communication channel 7E→the cavity S→the communication channel 7F→the cooling medium passage 5F→the cooling medium passage 5A again. Further, a second circulation pump is run to circulate supplied cooling water, through the leftmost cooling medium passage 6A within the lower pressing die 4→the communication channel 8A→the cavity S→the communication channel 8B→the cooling medium passage 6B→the cooling medium passage 6C→the communication channel 8C→the cavity S→the communication channel 8D→the cooling medium passage 6D→the cooling medium passage 6E→the communication channel 8E→the cavity S→the communication channel 8F→the cooling medium passage 6F→the cooling medium passage 6A again.

Thus, although the plate body 10 accommodated in the cavity S defined by the upper pressing die 3 and lower pressing die 4 is small in terms of the area where the plate body 10 is in contact with the cavity defining faces of the upper pressing die 3 and lower pressing die 4, the plate body 10 is quenched by its being sufficiently cooled with the circulating cooling water from both its sides. According to the type of the plate body 10, the quenching process is appropriately performed until the plate body 10 drops to a required temperature.

Specifically, cooling water is circulated to decrease the temperature of the plate body 10 by 30° C. or more per second, thereby continuing the quenching process until the plate body 10 drops to a temperature of 300° C. or less. Thereafter, the supply and circulation of cooling water is stopped, and the cooling water is discharged from the circulation passages. After the cooling water is discharged, the dies are opened, and a center pillar reinforcement member 1, as a martensite transformed product, is taken out from the cavity S.

By forming convex portions as in the foregoing embodiment, the required rigidity can be obtained without increasing plate thickness and, furthermore, even the steel plate with convex portions can be cooled under conditions adequate for quenching.

In the foregoing embodiment, the cooling medium passages 5 and 6 are formed in the upper pressing die 3 and lower pressing die 4 respectively, and the cooling medium passages 5 and 6 are formed so as to communicate with the cavity S via the communication channels 7 and 8 respectively. However, the cooling medium passage and the communication channel may be formed in either the upper pressing die 3 or lower pressing die 4 to carry out quenching.

While one embodiment of the invention has been described, it is to be understood that various alternative examples, modifications, or changes will occur to those skilled in the art and that the invention includes the various alternative examples, modifications, or changes without departing from the spirit of the invention.

INDUSTRIAL APPLICABILITY

The present invention is provided to manufacture products such as the structural members and reinforcement members of a vehicle by using a method for press-molding a steel plate embossed in a pattern in which a series of convex portions, a series of concave portions, or a series of concave and convex portions is repeated, in order to obtain required rigidity.

The invention claimed is:

1. A method for press-molding a steel plate embossed in a pattern in which a series of convex portions, a series of concave portions, or a series of concave and convex portions is repeated in order to obtain required rigidity, the method comprising:

accommodating the steel plate in a cavity defined by an upper die and a lower die and closing the dies, thereby applying pressure to the steel plate such that an empty space is defined between the steel plate and the cavity defining face of the upper or lower die by virtue of the convex portions, concave portions, or concave and convex portions; and quenching the steel plate by supplying a cooling medium into a plurality of cooling medium passages formed in at least one of the upper and lower dies along the cavity and into communication channels formed such that the cavity and the cooling medium passages communicate, and by circulating the cooling medium within each of the cooling medium passages, each of the communication channels, and the empty space defined in the cavity between the steel plate and the cavity defining face of the upper or lower die.

2. A method for press-molding a steel plate embossed in a pattern in which a series of convex portions, a series of concave portions, or a series of concave and convex portions is repeated in order to obtain required rigidity, the method comprising:

austenite-transforming the steel plate;

accommodating the austenite-transformed steel plate in a cavity defined by an upper die and a lower die and closing the dies, thereby applying pressure to the steel plate such that an empty space is defined between the steel plate and the cavity defining face of the upper or lower die by virtue of the convex portions, concave portions, or concave and convex portions; and quenching the steel plate by supplying a cooling medium into a plurality of cooling medium passages formed in at least one of the upper and lower dies along the cavity and into communication channels formed such that the cavity and the cooling medium passages communicate, and by circulating the cooling medium within each of the cooling medium passages, each of the communication channels, and the empty space defined in the cavity between the steel plate and the cavity defining face of the upper or lower die.

* * * * *